United States Patent [19]

Roettges et al.

[11] 4,222,307

[45] Sep. 16, 1980

[54] ARRANGEMENT FOR TILT-EQUALIZATION OF STEEP ANGLE FIRING WEAPONS

[75] Inventors: Werner Roettges, Krefeld; Wilfried Becker; Herbert Lipp, both of Duesseldorf, all of Fed. Rep. of Germany

[73] Assignee: Rheinmetall mbH, Duesseldorf, Fed. Rep. of Germany

[21] Appl. No.: 900,114

[22] Filed: Apr. 26, 1978

[30] Foreign Application Priority Data

May 14, 1977 [DE] Fed. Rep. of Germany ..... 2791906

[51] Int. Cl.[3] ..... F41F 1/06

[52] U.S. Cl. ..... 89/37 C; 89/37 G

[58] Field of Search ..... 89/1 F, 37 C, 37 G, 89/40 A, 41 T, 41 CE

[56] References Cited

U.S. PATENT DOCUMENTS 1,491,855 4/1924 Hall ..... 89/37 C 2,091,278 6/1936 Goebert ..... 89/37 G 2,599,565 6/1952 Lontz ..... 89/40 A

FOREIGN PATENT DOCUMENTS 300702 11/1920 Fed. Rep. of Germany ..... 89/37 C

*Primary Examiner*—Stephen C. Bentley

[57] ABSTRACT

A tilt-equalization arrangement for steep angle firing guns. The barrel of the gun has secured to its rear end a ball pin which is swivelably mounted within a ball socket. The ball socket is secured to a base plate. Forwardly of its rear end the barrel is provided with at least one longitudinally adjustable aligning post. The aligning post is slidably movably mounted on a circular ring segment forming a guide rail for the aligning post. This guide rail is vertically adjustable at its opposite ends so that it forms an adjustable leveling plane for the aligning post, with the ball pin forming a fixed support point and also being situated at the center of the circular ring segment forming the guide rail.

4 Claims, 3 Drawing Figures

ARRANGEMENT FOR TILT-EQUALIZATION OF STEEP ANGLE FIRING WEAPONS

BACKGROUND OF THE INVENTION

The invention relates to an arrangement for equalizing the tilt of steep-angle firing guns and the like. In such an arrangement a gun barrel is provided with at least one longitudinally adjustable aligning post mounted intermediate the forward and rear end of the gun barrel. A ball pin is rigidly secured to the rear end of the barrel and is swivelably mounted in a ball socket which in turn is rigidly secured to a base plate on which the gun is mounted.

Such types of gun mounts form part of the state of the art. Representatives of such gun mounts is a grenade launcher for wing-stabilized projectiles described in German published application No. 2,238,345. In this arrangement a gun barrel is also provided with a ball pin at its rear end which coacts with a ball socket rigidly and possibly adjustably mounted on a base plate. The gun barrel in this known arrangement is supported by a two-legged supporting frame having a height adjusting mechanism incorporated therein for adjusting the gun barrel height so as to position it at the desired angle. When it becomes necessary to correct the basic firing direction laterally with this known grenade launcher or perhaps change it completely, the two-legged support frame must be completely dismounted from its anchored position from the mount and must be repositioned and reanchored with the appropriate lateral alignment requiring a repositioning and reanchoring of its earth spur. In view of the fact that a change in the angle of direction of the gun barrel causes fundamentally also a change of the tilt angle, there must be taken into consideration that a change in the lateral angle position of the gun barrel causes a change in the tilt of the gun barrel. Therefore, the aligning process of the barrel with a gun sight and the remotely situated auxiliary target which requires erecting of aiming posts is not only time-consuming, cumbersome and complicated, but is also dangerous, because the external positioning of an auxiliary target makes it necessary to leave the gun site and thereby leaving its protective armor and camouflage.

In general, all mortars, grenade launchers and the like, whether fired from a fixed position or from and armored vehicle, are mounted according to the aforedescribed principle forming the state of the art, which is basically described in the German published patent application No. 2,238,345.

SUMMARY OF THE INVENTION

It is a general object of the invention to provide a support and mounting arrangement for steep-angle firing guns wherein the aforedescribed drawbacks are eliminated. This object is obtained by providing a support arrangement for the gun barrel, with which, prior to aiming the gun, the tilt of the barrel with respect to its longitudinal and transverse axis is compensated in such a way that, as long as the gun maintains its firing position, tile-equalization is maintained even when there occurs a change in the lateral direction of the gun.

According to the invention, this object is achieved by providing a leveling plane above the base plate which includes a circular ring segment in the shape of a guide rail for supporting the aligning posts which in turn support the gun barrel. The rear end of the gun barrel is provided with a ball pin which, when mounted in a ball socket secured to the base plate, forms the fixed point and center of the circular ring segment shaped guide rail. The guide rail is provided at its two ends with spindle sleeves in which threaded spindles are threadably mounted and in turn support the guide rail. These threaded spindles are provided with hand wheels at their upper ends so that they can be vertically adjusted within the spindle sleeves. The lower end of the threaded spindles bear against the base plate. By adjusting the threaded spindles in the spindle sleeves the guide rail can be leveled.

A further feature of the invention resides in that, on the one hand, the base plate is rigidly connected to the ball socket by means of a traverse, while, on the other hand, the aligning posts are provided with a carriage guide which has a mating recess corresponding to the diameter of the guide rail, so that the carriage guide can be slidably moved along the guide rail.

The advantages of the invention reside particularly in the fact that the firing position of the gun can be reaimed at will as often as is necessary, while the tilt-equalization has to be carried out only once. This not only makes for a more rapid and simpler aiming of the gun, but also makes it less dangerous because all steps for aiming the gun at the target can be carried out from within the safety of the armored vehicle or camouflaged gun emplacement.

BRIEF DESCRIPTION OF THE DRAWING

The invention is further set forth in the following detailed description taken in conjunction with the appended drawing, in which.

DETAILED DESCRIPTION

Figure 1:
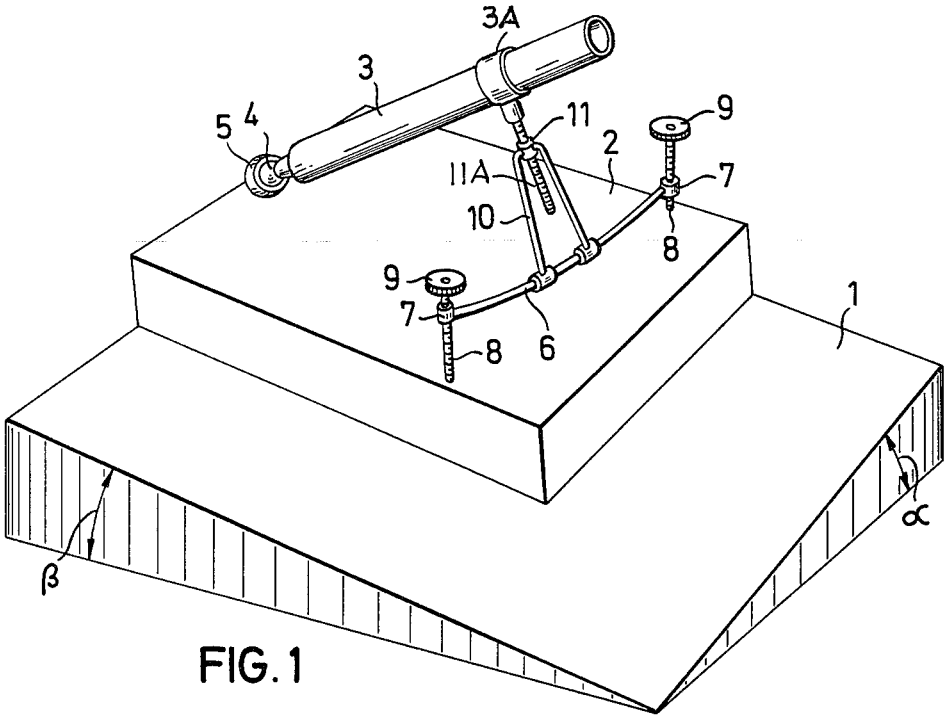
FIG. 1 is a perspective schematic view of an arrangement for aiming a steep-angle firing gun of this invention.

The support arrangement of the invention, insofar as its principle of operation is concerned, is schematically illustrated in FIG. 1

In this figure, the surface 1 represents a firing position. Thus, the surface 1 may be the surface of the terrain on which the gun is emplaced or on which an armored vehicle, having a steep-angle firing gun, has taken up a firing position. As can be seen, there is mountd on the surface 1 a base plate 2. A horizontal plane is illustrated by the two lower lines underneath the surface 1. As can be noted the surface 1 forms an arbitrary angle $\alpha$ relative to the basic direction of the gun as well as according to its height and forms an arbitrary angle $\beta$ relative to its lateral direction.

Since the base plate 2 is necessarily arranged parallel to the surface 1, the gun barrel 3, assuming it is arranged normal with respect to the base plate 2, would be tilted laterally as well as in the direction of the height of the gun barrel. The gun barrel 3 of a steep-angle firing gun, has at its rear end a ball pin 4 which is suitably mounted in a ball socket 5 of the base plate 2. The supporting arrangement for the gun barrel 3 is provided with a leveling plane disposed above the base plate 2. This leveling plane is formed by a circular segment-shaped guide rail 6. The ball socket and ball pin 4 represent a fixed support as well as the center of the circular segment-shaped guide rail 6.

There are provided a pair of internally threaded spindle sleeves 7 at opposite ends of the guide rail 6 to which the guide rail is connected. A pair of threaded spindles 8 are mounted respectively in the threaded sleeves 7 and bear, with their lower ends, against the base plate 2. Hand wheels 9 are respectively mounted on top of the threaded spindles 8. These hand wheels facilitate the turning of the spindles 8 and thereby facilitate to accurately level the guide rail 6 with the aid of suitable leveling indicators (not illustrated). The aligning posts 10 are supported by means of a guide carriage 12 (FIGS. 2 and 3) on the guide rail 6. The guide posts 10 are rigidly secured to a height adjusting mechanism 11 on which the gun barrel support mount 3*a* is threadably adjustably mounted via a threaded spindle 11*a*.

Figure 2:
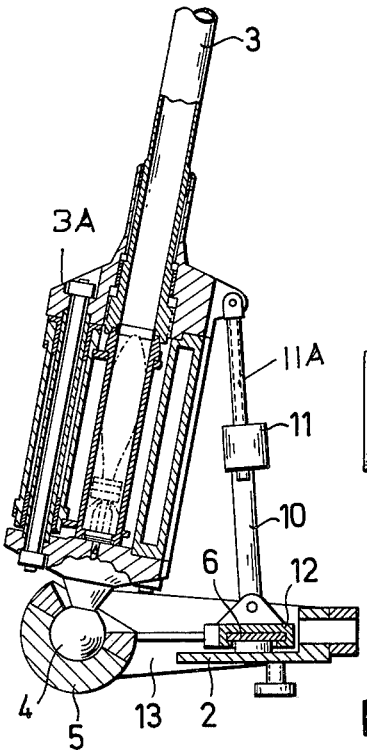
FIG. 2 is a side elevational view, shown partially in cross-section, wherein a steep-angle firing gun is shown supported by the arrangement of this invention for aiming the gun.
Figure 3:
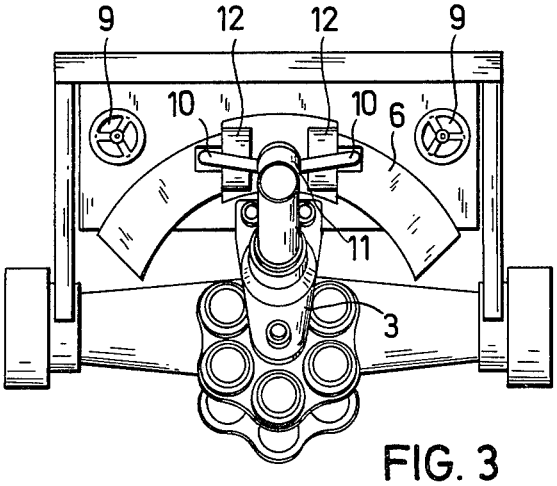
FIG. 3 is a plan view taken from above of the gun and support arrangement of FIG. 2.

As can be particularly seen in FIG. 2, the lower end of the aligning post 10 is provided with a carriage guide 12 which matingly embraces the guide rail 6 so that the carriage guide 12 is movable thereon. The guide rail 6 in turn is rigidly secured to the ball socket via a traverse 13 (see FIG. 2).

It is contemplated and within the scope of the invention to provide the hand wheels 9 with remote control mechanisms so that they can be operated by remote control. Furthermore, it is within the scope of this invention to automate the entire tilt-equalization process.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. An improved arrangement for equalizing the tilt of steep-angle firing guns, wherein the barrel of the gun is provided at its rear end with a ball pin which is swivelably mounted in a ball socket fixedly secured to a base plate, the improvement comprising, an at least partially circular segment-shaped leveling guide rail means operatively mounted above said base plate, said ball pin and socket being positioned at the center of said circular segment-shaped leveling guide rail means;

carriage means operatively suporting said gun barrel forwardly of its rear end and being in turn adjustably mounted on said circular segment-shaped leveling guide rail means; and height adjusting means on said base plate and operatively connected to said leveling guide rail means for adjusting the tilt angle thereof to thereby aid in aiming the steep- angle firing gun;

said carriage means include a slide movably mounted on said guide rail and said height adjusting means include a pair of sleeves spaced from each other and connected to said guide rail means, a pair of spindles adjustably mounted in said pairs of sleeves, the lower ends of said spindles resting on said base plate.

2. The improvement in an arrangement for equalizing the tilt of steep-angle firing guns as set forth in claim 1, including means positively connecting said guide rail to said socket.

3. The improvement in an arrangement for equalizing the tile of steep-angle firing guns as set forth in claim 1, wherein said carriage means include a pair of guide posts and a threaded bushing connected to the pair of guide posts, a threaded support rod operatively connected to the gun barrel and threadably mounted in said threaded bushing.

4. The improvement in an arrangement for equalizing the tilt of steep-angle firing guns, as set forth in claim 1, wherein said sleeves and spindles are threaded and said spindles are threadably mounted in said sleeves.

* * * * *